US005711043A

United States Patent [19]

Crawford et al.

[11] Patent Number: 5,711,043

[45] Date of Patent: Jan. 27, 1998

[54] SET TOOL AND CAP

[75] Inventors: Trevor J. Crawford; Dennis P. Rolph, both of Charles City, Iowa

[73] Assignee: Diversified Fastening Systems, Inc., Charles City, Iowa

[21] Appl. No.: 728,248

[22] Filed: Oct. 8, 1996

[51] Int. Cl.[6] ..... B25B 15/00; B26B 11/00

[52] U.S. Cl. ..... 7/165; 7/158

[58] Field of Search ..... 7/165, 158; 81/439, 81/438; 279/83, 89, 93; 408/118, 119

[56] References Cited

U.S. PATENT DOCUMENTS

| | | | |
|---|---|---|---|
| 2,515,839 | 7/1950 | Robertson | 81/438 |
| 3,484,114 | 12/1969 | Rodin | 7/165 |
| 3,965,510 | 6/1976 | Ernst | 7/165 |
| 4,092,753 | 6/1978 | Fuhrmann | 7/165 |
| 4,404,874 | 9/1983 | Lieser | 81/438 |
| 4,954,025 | 9/1990 | Crawford et al. | 7/165 |
| 5,038,435 | 8/1991 | Crawford et al. | 7/165 |
| 5,222,848 | 6/1993 | Kuang-Wu | 7/165 |

*Primary Examiner*—Eileen P. Morgan
*Assistant Examiner*—Joni B. Danganan
*Attorney, Agent, or Firm*—G. Brian Pingel; Brett J. Trout

[57] ABSTRACT

A tool adapted for use with a drill for installing screw anchors in concrete or masonry walls or the like having a sleeve type body, a bit holder slidably located in the body, a drill bit with a handle secured in the bit holder, a coil spring seated on a collar of a bit holder and extending around the bit, a set screw to retain the drill bit in the bit holder and also to serve as a means to advance and retract the drill bit, a cutout comprised of a longitudinal slot, a retainer notch, and at least one depth notch, and a driver seat capable of retaining a driver bit and further capable of releasable attachment to the sleeve type body. The attachment cap allows ready conversion of the tool from a drill to a driver and back again.

18 Claims, 3 Drawing Sheets

SET TOOL AND CAP

BACKGROUND OF THE INVENTION

1. Field of the Invention

The present invention relates in general to a tool adapted for use with a hand drill for installing screw anchors in concrete or masonry walls and more specifically relates to such tools that have components designed to improve driver installation and removal to increase tool operation and efficiency.

2. Description of the Prior Art

Anchor set tools having a general configuration similar to that of the present invention are known in the art. The general configuration of such known anchor set tools include a sleeve type body in which a bit is retractably received, and there is a nut driver located on one end of the body. The bit holder is slidably located in the bore of the sleeve type body for receiving a handle of the drill bit and has a bit retention means that extends from one side through a slot in the body so that the drill bit can be positioned with respect to the body as generally taught in U.S. Pat. Nos. 4,954,025 and 5,038,435.

Although anchor set tools of the above general configuration have proved usual and efficient in comparison to prior methods of setting anchors, such prior devices have suffered from deficiencies that affect their operational function. For example, in prior devices the driver is not secured to prevent the driver from becoming inadvertently dislodged from the tool. In prior devices, the driver is typically located within a slot provided within one end of the body. Although a deeper slot provides added stability to the driver bit, the present invention is an improvement over the above-described devices and eliminates the foregoing described deficiencies by further stabilizing the bit against inadvertent dislodgement from the body.

SUMMARY OF THE INVENTION

The present invention provides an improved tool adapted for use with a hand drill for installing screw anchors in concrete or masonry walls or the like. The invention includes a sleeve type body, a bit holder slidably located in a bore provided in the body, a drill bit secured in the bit holder, a driver seat releasably secured over the body, a coil spring through which the bit extends to serve as a biasing means for urging the bit in a rearward direction in the body bore and means for preventing the driver seat from twisting relative to the body.

In the preferred embodiment, the bit holder has a set screw extending from one side of the holder through the slot in the body to serve as a guide for manually moving the bit with respect to the body and as a means for retaining the bit in the bit holder. The bit holder is formed with a cavity for receiving the smooth end of the drill bit with the cavity wall closely encircling the smooth end to prevent the bit from wobbling with respect to the holder.

The driver seat is releasably secured over the front section of the body. To accomplish this the driver seat is provided with a slot sized to accommodate the front section of the body. The driver seat is also provided with a receptacle sized to accommodate a driver. Means are also provided for preventing the driver seat from twisting relative to the body once the driver seat has been releasably secured over the front section of the body.

DETAILED DESCRIPTION OF THE PREFERRED EMBODIMENT

Figure 1:
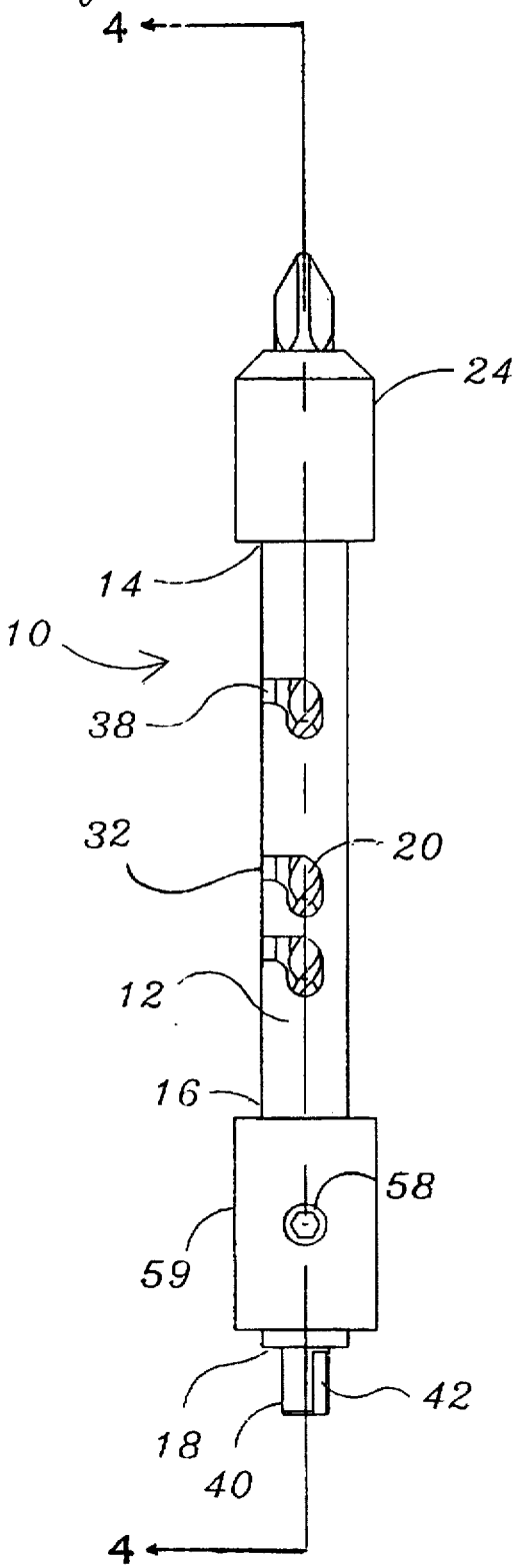
FIG. 1 is a side elevation of a preferred embodiment of an improved anchor set tool of the present invention that includes a releasably secured driver seat.

With reference to the drawings, the anchor set tool of this invention is indicated generally as 10 in FIG. 1, and includes a cylindrical, sleeve type body 12, with a front section 14, a middle section 16, and a rear section 18. A drill bit 20, (FIGS. 3 and 4) is secured to a bit holder 22, which is slidably located in the body 12. An attachment cap 24, is secured to the front end 14 of the body 12, and a coil spring 26 serves as a biasing means to urge the bit holder 22 rearwardly in the body 12.

Figure 2:
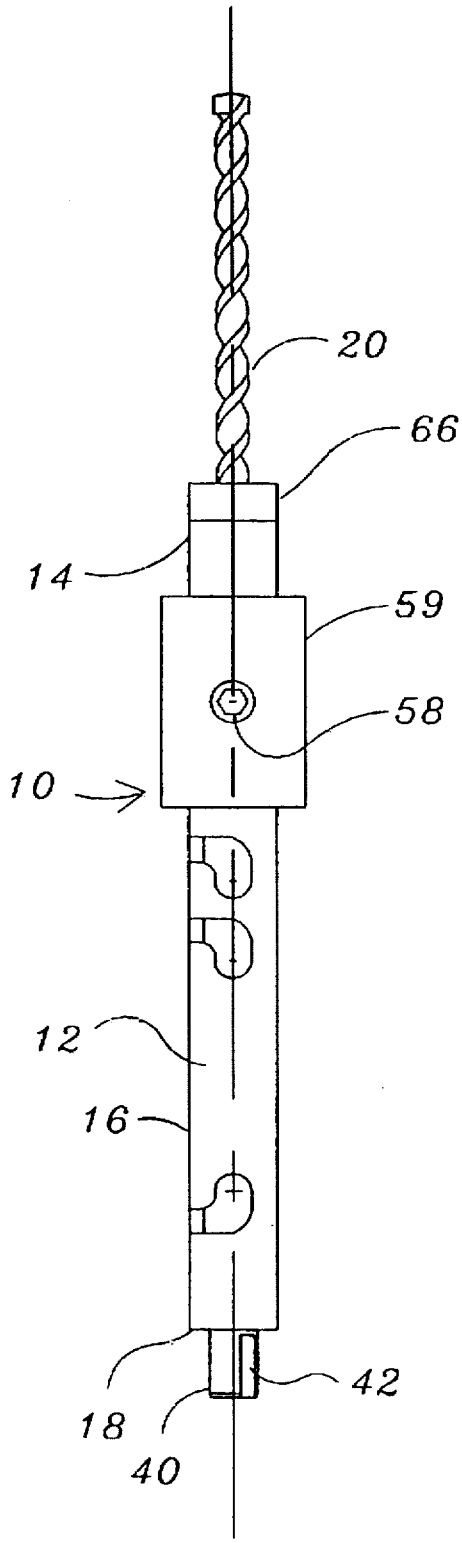
FIG. 2 is a view similar to that of FIG. 1 with the driver seat removed and the drill bit of the preferred embodiment shown in an extended position.
Figure 3:
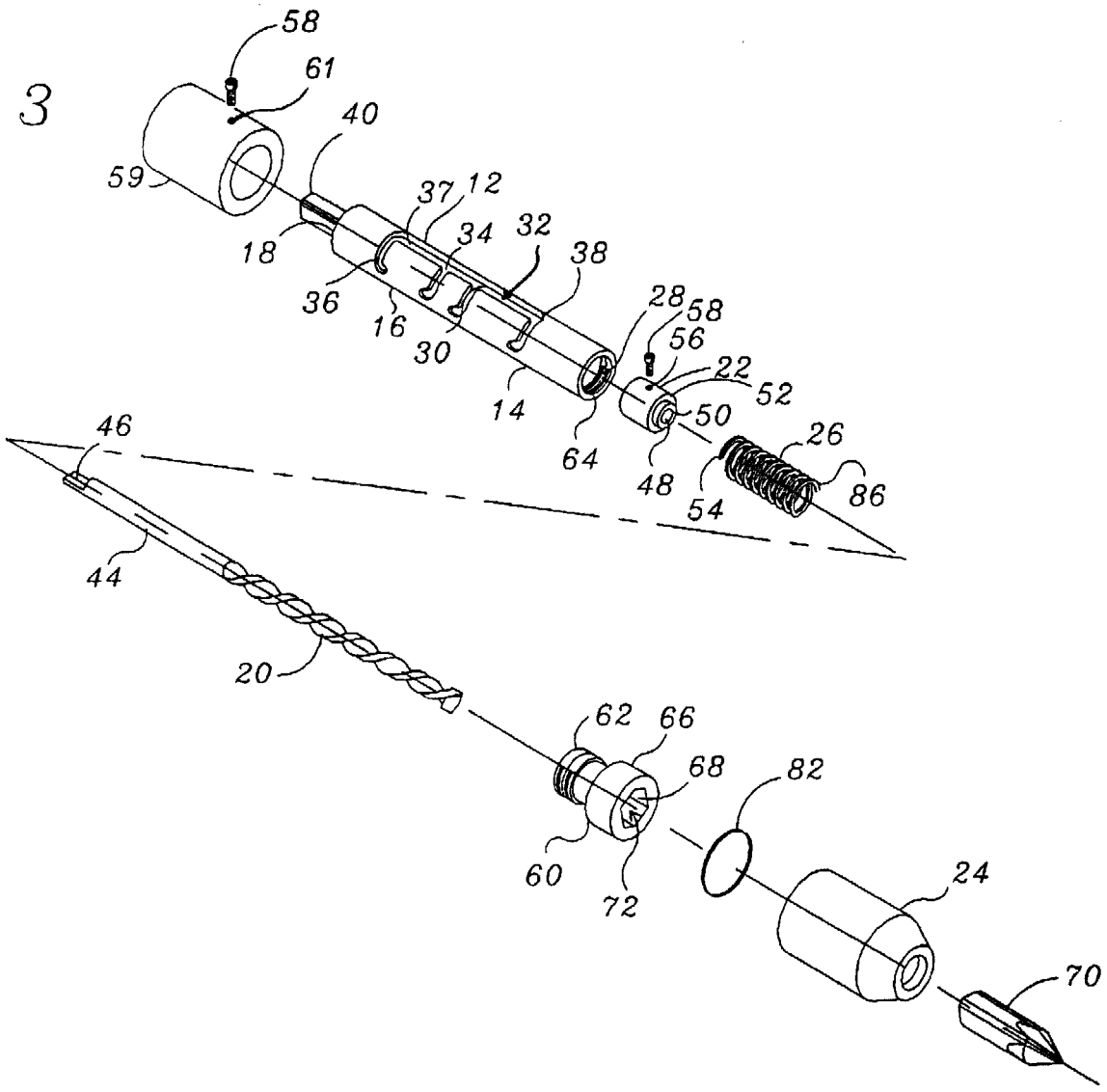
FIG. 3 is an exploded perspective view of the embodiment of FIG. 1.
Figure 5:
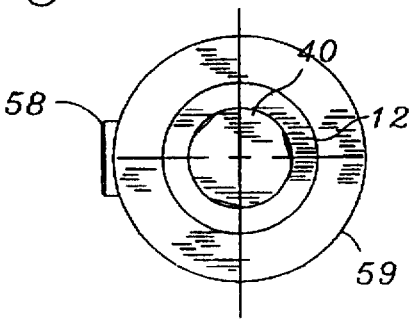
FIG. 5 is a bottom view of the embodiment of FIG. 2.
Figure 6:
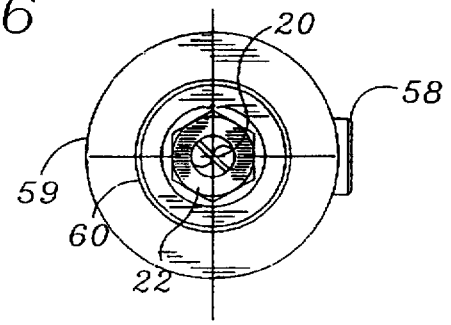
FIG. 6 is a top view of the embodiment of FIG. 2.
Figure 7:
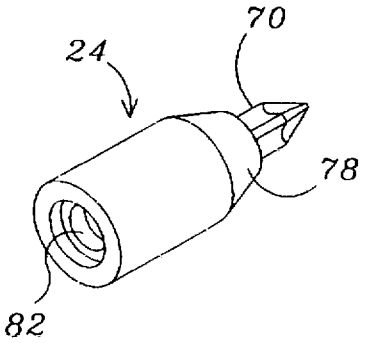
FIG. 7 is a perspective view of the driver seat of the present invention.

Referring to FIG. 3, the front section 14 of the body 12 is threaded internally for a purpose to be described later. The middle section 16 of the body 12 is tubular in cross-section and consists of an axial bore 28 and a wall 30. The wall 30 includes a cutout 32 consisting of a longitudinal slot 34, a retainer notch 36, and an arrangement of depth notches 38. The rear section 18 of the body 12 is formed as a generally cylindrical shape and, as shown in FIGS. 1, 2, and 5, a handle 40 extends outwardly therefrom. The handle 40 has a plurality of flat surfaces 42 equally spaced radially for positive engagement with a three jaw chuck of a drill (not shown).

Referring again to FIG. 3, the drill bit 20, of conventional design for drilling masonry, concrete or the like, includes a smooth end 44 with a flat stepped portion 46 to be received into the bit holder 22. The bit holder 22 is cylindrical in shape with an outside diameter sized to allow the holder 22 to slide freely within the axial bore 28 of the body. The bit holder 22 is formed with a cavity 48 for receiving the smooth end 44 of the drill bit 20.

The cavity 48 has a sidewall 50 that closely encircles the smooth end 44 and prevents the drill bit 20 from wobbling with respect to the bit holder 22. Adjacent the cavity 48 is an integral retainer collar 52 sized to fit within a rear end 54 of the coil spring 26 and serve as a seat therefor. Perpendicular to the cavity 48 of the bit holder 22, and intersecting with it is a tapped hole 56 for receiving a set screw 58. As shown in FIG. 3, a safety sleeve 59 is provided with an interior diameter similar to the exterior diameter of the body 12 to allow the safety sleeve 59 to slide across the body 12. The safety sleeve 59 is also provided with a tapped hole 61 to receive the set screw 58.

A driver seat 60 is provided with a cylindrical shape having an externally threaded neck portion 62 which can be screwed into a threaded section 64 of the body front section 14. The driver seat 60 is also provided with a head portion 66. Formed in the head portion 66 is a recessed hex drive socket 68 for receiving a standard screwdriver bit 70, many shapes and sizes of which are readily available. Also formed in the driver seat 60 is a throughbore 72 (FIG. 4) for passage of the drill bit 20. The throughbore 72 is smaller in diameter than the socket 68 so that the socket 68 and the throughbore 72 form a stair stepped configuration. The throughbore 72 is of a close enough fit to provide stability to the drill bit 20 when extended for drilling, and sufficiently long enough to insure that the drill bit 20, when retracted, will have its front end located in the throughbore 72 but not contacting the end of the screwdriver bit 70 when seated in the socket 68.

Figure 4:
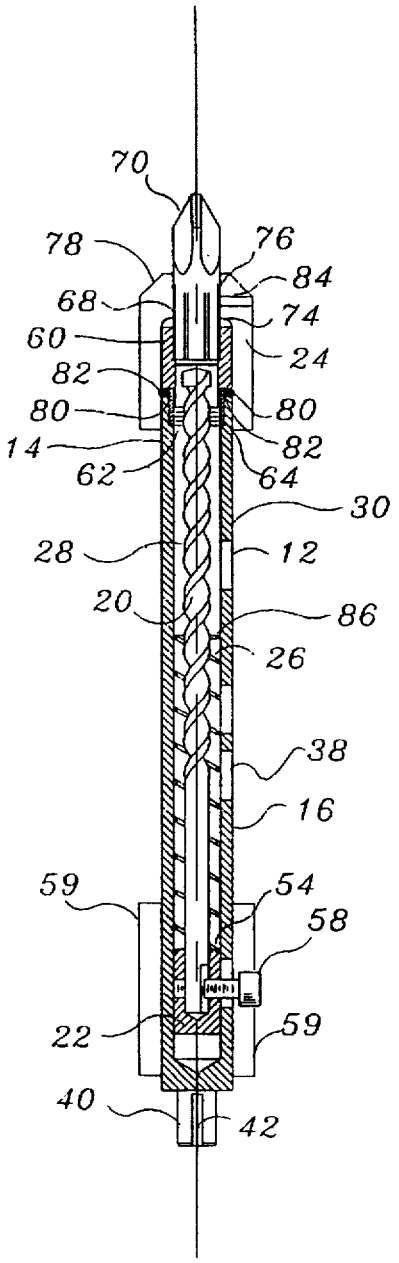
FIG. 4 is a cross-sectional view taken along the line 4—4 of FIG. 1.

As shown in FIG. 4, the attachment cap 24 is provided with a large diameter lower bore 74 and a small diameter upper bore 76. The lower bore 74 is sized to accommodate the driver seat 60 and the body 12 while the upper bore 76 is sized to accommodate the screwdriver bit 70. Preferably, the attachment cap 24 is provided with chamfered sides 78 to prevent marking or gouging of a working surface (not shown). The large diameter lower bore 74 of the attachment cap 24 is provided with an annular recess 80. Provided within the annular recess 80 is an O-ring 82 sized to fit snugly within the annular recess 80. As shown in FIG. 4, a set screw 84 is provided in the attachment cap 24 to secure the screwdriver bit 70 within the small diameter upper bore 76 of the attachment cap 24.

The anchor set tool 10 is assembled by inserting the smooth end 44 of the drill bit 20 into the bit holder 22 so as to align the flat portion 46 directly under the tapped hole 56 (FIG. 3). Next, the coil spring 26 is slid over the drill bit 20 and is captured by the retaining collar 52 of the bit holder 22. This assembly is then slid into the bore 28 of the body 12 so that the tapped hole 56 is aligned with the longitudinal slot 34 of the cutout 32. The safety sleeve 59 is slidably coupled over the body 12 with the tapped hole 61 provided in alignment with the tapped hole 56 of the bit holder 22. The set screw 58 is then threaded into the tapped hole 61 of the safety sleeve 59, inserted through the slot 34, and threaded into the tapped hole 56 of the bit holder 22. The set screw 58 is tightened down onto the flat portion 46 of the drill bit 20, thereby retaining the drill bit 20 in the holder 22. Thus, the safety sleeve 59 is slidably retained over the body 12 and the drill bit 20 and the bit holder 22 are slidably retained in the bore 28 of the body 12. The driver seat 60 is screwed into the front section 14 of the body 12.

The coil spring 26 is provided with a front end 86 as well as a rear end 54. The rear end 54 of the coil spring 26 abuts against the bit holder 22 when the spring 26 is seated about the retainer collar 52. When the bit holder 22 is advanced forwardly in the axial bore 28 of the body 12 by means of the safety sleeve 59, the front end 86 of the coil spring 26 comes into engagement with and abuts against the neck portion 62 of the driver seat 60 causing the coil spring 26 to become compressed between the bit holder 22 and the neck portion 62. When compressed, the coil spring 26 acts as a bias means to urge the bit holder 22 and the drill bit 20 in a rearward direction within the axial bore 28. When the drill bit 20 is the in the retracted position (FIG. 4), the coil spring 26 is relaxed and free from contact with the neck portion 62. It will be noted that while retracted, the point of the drill bit 20 is contained by the through bore 72 of the attachment cap 24, but is sufficiently recessed so as not to come in contact with the rear of the screwdriver bit 70 when the screwdriver bit is seated within the socket 68 of the driver seat 60.

When the screwdriver 70 is not seated in the socket 68 of the driver seat 60, the bit 20 can be moved through the driver seat 60 to project outwardly therefrom. This movement is accomplished by rotating the safety sleeve 59 until the set screw 58 moves out of the retainer notch 36. The safety sleeve 59 is then slid linearly along the longitudinal slot 34 against the bias of the coil spring 26 to extend the drill bit 20 past the head portion 66 (FIG. 3). The depth notches 38 vary in quantity, location and dimensions and are designed for alternatively receiving the set screw 58 so that the extension of the drill bit 20 can be varied to control the drilling depth to accommodate various lengths of anchor screws (not shown).

After a hole (not shown) is drilled in a wall (not shown), the anchor set tool 10 is pulled away from the hole. As the anchor set tool 10 is pulled, friction between the wall and the drill bit 20 moves the set screw 58 along the arcuate portion of the depth notch 38 until the set screw 58 moves into the longitudinal slot 34. Once the drill bit 20 is pulled completely away from the wall, the coil spring 26 forces the set screw 58 along the longitudinal slot 34 until the drill bit 20 is completely retracted. In this manner, the anchor set tool 10 automatically retracts the drill bit 20 after drilling to place the anchor set tool 10 in a configuration for inserting an anchor screw (not shown). To begin driving an anchor screw, the screwdriver bit 70 is inserted into the small diameter upper bore 76 of the attachment cap 24 until the screwdriver bit 70 extends into the large diameter lower bore 74 of the attachment cap 24. The set screw 84 is then tightened into the attachment cap 24 until the screwdriver bit 70 is locked into place within the small diameter upper bore 76 of the attachment cap 24. The attachment cap 24 is then placed over the driver seat 60 and positioned so that the screwdriver bit 70 fits snugly within the socket 68 of the driver seat 60 and the O-ring 82 is in contact with the body 12 of the anchor set tool 10. Preferably, the diameter of the large diameter lower bore 74 and O-ring 82 of the attachment caps 24 are sized so as to minimize the wobbling and inadvertent dislodgement of the attachment cap 24 relative to the driver seat 60 and body 12 of the anchor set tool 10.

As the anchor set tool 10 is rotated to install an anchor screw (not shown) the resistance of the anchor screw to insertion is torsionally transmitted through the screwdriver bit 70 and through the socket 68 of the driver seat 60 in a clockwise manner. The driver seat 60 is preferably torqued during assembly to a valve sufficient to prevent removal of the driver seat 60 from the body 12 if it is desired to remove an anchor screw. Anchor screws may, therefore, be both inserted and removed with the anchor set tool 10 of the present invention.

Although the invention has been described to a preferred embodiment thereof, it is to be understood that it is not to be so limited, since changes in modifications can be made therein which are in the full intended scope of this invention as defined by the appended claims.

What is claimed is:

1. An improved tool adapted for use with a hand drill for installing screw anchors in concrete or masonry walls or the like, comprising:

(a) a sleeve type body having:
  (1) an axial bore with a closed rear section and an open front section;
  (2) a longitudinally aligned open slot in said body; and
  (3) at least one depth notch associated with said front portion of said slot;

(b) a handle extending outwardly from said rear section of said body and receivable in a chuck of the drill;

(c) a drill bit with a smooth end, with a flat stepped portion;

(d) a bit holder slidably located in said bore and having an axial cavity and a bit retention means that extends from one side of said holder through the slot in said body and secures said bit in said cavity where a sidewall of said bit holder cavity closely encircles said smooth end;

(e) a coil spring through which said bit extends, said coil spring having a rear end that abuts against said bit holder, said spring serving as a bias means to urge said bit in a rearward direction; and (f) a driver seat releasably secured over said front section of said body, said driver seat having:

(1) a cap having a first bore sized to accommodate said front section of said body and a second bore sized to accommodate a driver; wherein said first bore of said cap is open to said second bore of said cap (2) a driver extending from said cap;

(3) means for releasably securing said cap over said front section;

(4) means for preventing said driver seat from twisting relative to said body; and (5) means for retaining the driver within said second bore of said cap.

2. An improved tool as recited in claim 1, further comprising a driver means located at the front section of said body and having:

(a) a head portion with a socket; and (b) a neck portion positioned in the bore of said body and having a passageway that extends from the said socket through said neck portion and opens to said body bore for closely encircling said bit to serve as a bit guide means.

3. An improved tool as recited in claim 2, wherein said socket of said driver means has a first recessed portion for receiving a driver bit and a second portion in which an end of said drill bit can be located without contacting said driver bit.

4. An improved tool as recited in claim 1, wherein said bit holder has a forward protruding collar portion aligned with said cavity and said rear end of said coil spring is seated on said collar to stabilize said end in said body bore.

5. An improved tool as recited in claim 1, wherein the sidewall of said bit holder cavity closely encircles a portion of said bit to prevent said bit from wobbling with respect to said holder.

6. An improved tool as recited in claim 1, wherein said depth notch is formed to extend outwardly from said slot in an arcuate fashion so that said bit retention means slides into or out of said depth notch with a uniform movement.

7. An improved tool as recited in claim 1, further comprising an O-ring secured against movement relative to an interior wall of said first bore of said cap.

8. An improved tool as recited in claim 1, wherein said driver seat is provided with a chamfered edge.

9. An improved tool adapted for use with a hand drill for installing screw anchors in concrete or masonry walls or the like, comprising:

(a) a sleeve type body having:

(1) an axial bore with a closed rear section and an open front section;

(2) a longitudinally aligned open slot in said body; and (3) at least one depth notch associated with said front portion of said slot;

(b) a handle extending outwardly from said rear section of said body and receivable in a chuck of the drill;

(c) a drill bit with a smooth end, with a flat stepped portion;

(d) a bit holder slidably located in said bore and having an axial cavity and a bit retention means that extends from one side of said holder through the slot in said body and secures said bit in said cavity where a sidewall of said bit holder cavity closely encircles said smooth end;

(e) a coil spring through which said bit extends, said coil spring having a rear end that abuts against said bit holder, said spring serving as a bias means to urge said bit in a rearward direction; and (f) a driver seat releasably secured over said front section of said body, said driver seat having:

(1) a cap having a first bore sized to accommodate said front section of said body and a second bore sized to accommodate a driver;

(2) a driver secured to said cap; and (3) means for releasably securing said cap over said front section.

10. An improved tool as recited in claim 9, further comprising a driver means located at the front section of said body and having:

(a) a head portion with a socket; and (b) a neck portion positioned in the bore of said body and having a passageway that extends from the said socket through said neck portion and opens to said body bore for closely encircling said bit to serve as a bit guide means.

11. An improved tool as recited in claim 10, wherein said socket of said driver means has a first recessed portion for receiving a driver bit and a second portion in which an end of said drill bit can be located without contacting said driver bit.

12. An improved tool as recited in claim 9, wherein said bit holder has a forward protruding collar portion aligned with said cavity and said rear end of said coil spring is seated on said collar to stabilize said end in said body bore.

13. An improved tool as recited in claim 9, wherein the sidewall of said bit holder cavity closely encircles a portion of said bit to prevent said bit from wobbling with respect to said holder.

14. An improved tool as recited in claim 9, wherein said depth notch is formed to extend outwardly from said slot in an arcuate fashion so that said bit retention means slides into or out of said depth notch with a uniform movement.

15. An improved tool as recited in claim 9, wherein said first bore of said cap is open to said second bore of said cap.

16. An improved tool as recited in claim 15, further comprising a set screw located for retention of a driver within said second bore of said cap.

17. An improved tool as recited in claim 15, further comprising an O-ring secured against movement relative to an interior wall of said first bore of said cap.

18. An improved tool as recited in claim 9, wherein said driver seat is provided with a chamfered edge.

* * * * *